United States Patent [19]

Vogt

[11] Patent Number: 4,529,236

[45] Date of Patent: Jul. 16, 1985

[54] ANIMAL DROPPINGS PICKUP DEVICE

[76] Inventor: Kuno J. Vogt, 4250½ Fairmont Ave., San Diego, Calif. 92105

[21] Appl. No.: 510,574

[22] Filed: Jul. 5, 1983

[51] Int. Cl.[3] ..... A01K 29/00; B65D 13/06

[52] U.S. Cl. ..... 294/1.3; 220/351; 229/9

[58] Field of Search ..... 294/1 B, 55; 15/104.8, 15/257.1, 257.6; 220/252, 345, 346, 351, 8; 229/9, 19, 52 AC, 52 AL

[56] References Cited

U.S. PATENT DOCUMENTS

| | | | |
|---|---|---|---|
| 2,102,094 | 12/1937 | Romig | 220/351 |
| 3,389,847 | 6/1968 | Darot | 229/9 |
| 3,417,910 | 12/1968 | Johnson | 229/19 |
| 3,560,039 | 2/1971 | Gruber | 294/1 B |
| 3,927,820 | 12/1975 | Wagner et al. | 220/345 X |
| 4,017,015 | 4/1977 | Jefferson | 294/1 B |
| 4,201,409 | 5/1980 | O'Hara | 294/1 BA |
| 4,215,888 | 8/1980 | Gavin et al. | 294/1 B |
| 4,360,148 | 11/1982 | Forbes | 220/351 X |

FOREIGN PATENT DOCUMENTS

| | | | |
|---|---|---|---|
| 4447 | of 1926 | Australia | 220/351 |
| 2802627 | 7/1979 | Fed. Rep. of Germany | 294/1 B |
| 2830983 | 1/1980 | Fed. Rep. of Germany | 294/1 B |

*Primary Examiner*—Johnny D. Cherry
*Attorney, Agent, or Firm*—Charles C. Logan, II

[57] ABSTRACT

The portable device for picking up animal droppings has a tray, a cover member, and a sheet of flexible material. The cover member is slidingly engaged to the top surface of the tray and a cord handle is attached to one end of the cover for carrying the portable device. The use of the portable device results in the picking up of the animal droppings while not requiring the person to touch the same. During this operation the animal droppings are wrapped as a package within the flexible sheet of material as they are both drawn onto the top of the tray beneath the cover member.

15 Claims, 10 Drawing Figures

ANIMAL DROPPINGS PICKUP DEVICE

BACKGROUND OF THE INVENTION

The present invention relates to devices for picking up animal droppings and more particularly for use relating to domestic animals such as cats and dogs.

Pet waste is now considered to an environmental problem of major proportions. As a result, many communities have been enacting regulations requiring pet owners to dispose of solid waste material deposited by their pets on public streets and parks.

Accordingly, a variety of scoops, scrapers, pans and related receptacles or containers have been provided for effecting removal and subsequent disposal of solid pet waste. One of the more frequently employed varieties of such prior receptacles consists of a two piece-hinged or or jaw-like waste enclosure having an elongated handle with which to manipulate the enclosure to pivot between open and closed positions in picking up waste material deposited on the ground. However, this type of receptacle is relatively expensive and somewhat awkward to carry around, thereby, increasing the burden on the pet owner of the obligation to clean up after the pet.

Another known type of waste removal aid consists of a disposable pan into which pet waste is pushed or shoveled. The pan is formed from a folded blank into an open-ended box having a flat shovel-like extension at the open onto which the waste material can be pushed. Disposable pans of this type, however, while convenient in many respects, have suffered from the disadvantage of requiring the pet owner to carry a separate shovel or pusher implement with which to scrape or push the waste material off the street and into the pan.

These and other disadvantages of the previously known waste removal implements are obviated by the present invention.

It is an object of the invention to provide a novel animal droppings pickup device that is compact and light in weight.

It is also an object of the invention to provide a novel animal droppings pickup device that is economical to manufacture and market.

It is also an object of the invention to provide a novel animal dropping pickup device that doesn't require a person to touch the animal droppings.

It is another object of the invention to provide a novel animal droppings pickup device that is reusable and doesn't require the device to washed between uses since the animal droppings do not come in direct contact with either the tray or cover member.

It is a further object of the invention to provide a novel animal droppings pickup device that functions to wrap the animal droppings in a disposible package during its operation.

It is an additional object of the invention to provide a novel animal droppings pickup device that is easily carried about by the pet owner.

DESCRIPTION OF THE PREFERRED EMBODIMENT

Figures 1, 1A, 2, 3, 4, 5:
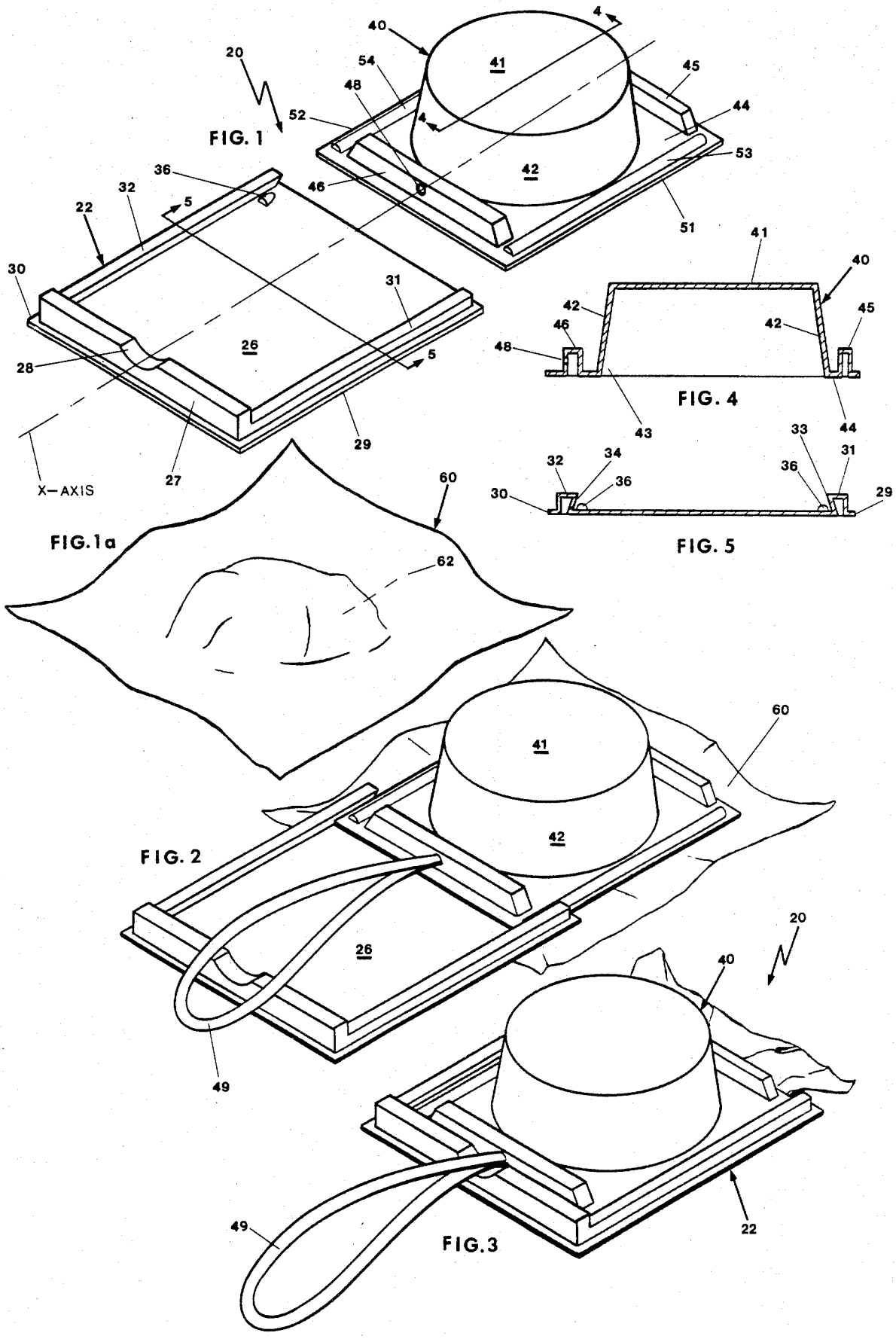
FIG. 1 is an exploded view of the novel animal droppings pickup device.
FIG. 1*a* is a perspective view of the sheet of flexible material that may be used with the novel animal dropping pickup device.
FIG. 2 is a perspective view illustrating the novel animal droppings pickup device in its open state while placed on the sheet of flexible material.
FIG. 3 is a perspective view of the novel animal droppings pickup device after it has picked up the animal waste material and the sheet of flexible material.
FIG. 4 is a cross-sectional view taken along lines 4—4 of FIG. 1.
FIG. 5 is a cross-sectional view taken along lines 5—5 of FIG. 1.
Figure 6:
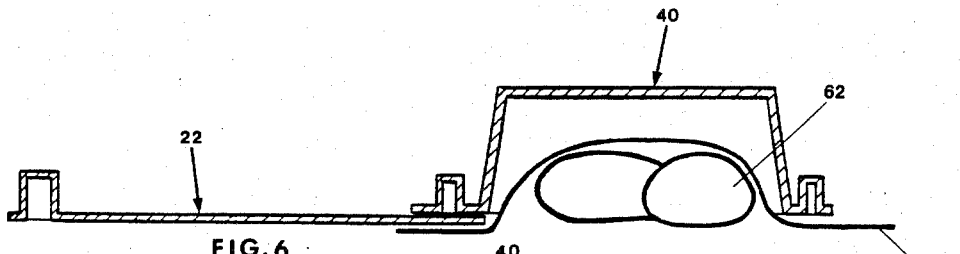
FIG. 6 is a schematic cross-sectional view illustrating the novel animal droppings pickup device in its first stage of operation.
Figure 7:
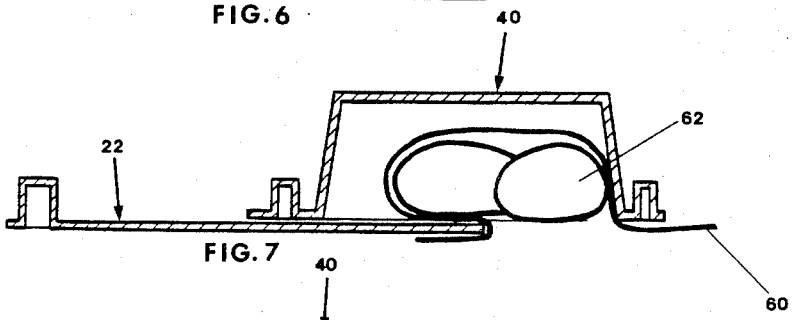
FIG. 7 is a schematic cross-sectional view illustrating the novel animal droppings pickup device in an intermediate stage of operation.

Applicant's novel animal droppings pickup device is generally designated numeral 20 and will be described by referring to FIGS. 1–8 of the drawings. There are two basic components to the device, tray member 22 and cover member 40.

Tray member 22 has a planar base portion 26, and an upstanding rear wall 27 having a cut-out portion 28 in its top surface. Tray 22 has a longitudinally extending x-axis and lateral side edges 29 and 30. Extending upwardly from the respective lateral side edges 29 and 30 are rib stiffeners 31 and 32 having respectively inner wall members 33 and 34. A pair of laterally spaced retainer members 36 extend upwardly above the top surface of planar base portion 26.

Cover member 40 has a top wall 41 and side walls 42. The bottom edge of side walls 42 form an opening 43. Extending outwardly from the bottom edges of side walls 42 is a base wall 44 and rib stiffener members 45 and 46 extend upwardly therefrom, respectively at the front and rear of said cover member. Rib stiffener member 46 has an aperture 48 passing longitudinally through it along the x-axis of the cover member and cord handle 49 has its opposite ends of the loop of material threaded through aperture 48 with a knot tied in it to prevent the handle from pulling out of aperture 48. Base wall 44 has lateral side edges 51 and 52. A pair of laterally spaced alignment guide tracks 53 and 54 protrude upwardly from the top surface of base wall 44. The bottom surface of alignment guide tracks 53 and 54 are concave and they function as a track as they travel along retainer members 36 that protrude upwardly from the top surface of the planar base portion 26 of tray 22. When the tray and cover member are in their assembled state the retainer members 36 become captured at the end of the alignment guide tracks 53 and 54 to keep the two components from accidentally separating from each other.

Figure 8:
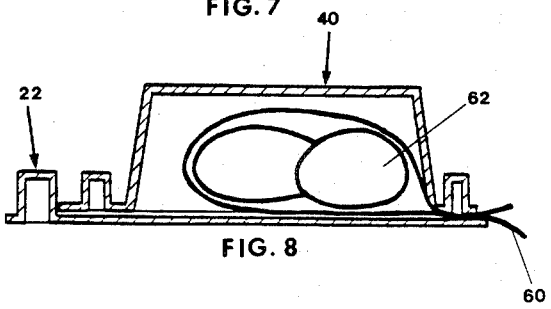
FIG. 8 is a schematic cross-sectional view illustrating the novel animal droppings pickup device in its final stage of operation.

In FIG. 1*a*, a sheet of flexible material 60 has been placed over the animal droppings 62. The thickness of the sheet of flexible material is preferably such that of its own weight it will droop downwardly until it is on a supporting surface whether that be the animal droppings or the ground itself. In FIG. 2 pickup device 20 has its cover member 40 placed over top of the sheet of flexible material 60. In FIG. 3 cover member 40 has been slid rearwardly and while this occurs the sheet of flexible material has captured the animal droppings beneath it and both the sheet of material 60 and the animal droppings are transported beneath cover member 40 onto tray 22. The actual sequence is more clearly depicted in FIGS. 6–8. There it can be seen that as the forward edge of the tray 22 is placed upon the rear edge of the sheet of flexible material 60, this action serves to capture it there. Then as the cover member is pushed both downwardly and rearwardly along tray 22, this action results in picking up the animal droppings and carrying them beneath the cover member onto the tray 22 ending up in a packaged manner as illustrated in FIG. 8. At this stage, the device 20 can be picked up by the cord handle 49 and looped over the persons wrist for carrying purposes. The entire operation of picking up the animal droppings is accomplished without the necessity of touching the animal droppings in any manner. When a receptacle is found for the animal droppings, it is only necessary to reverse the direction of sliding the cover member to its open state thereby allowing the packaged animal droppings in the sheet of flexible material 60 to drop outwardly therefrom. Since the animal droppings have contacted neither the inside of the cover member or the top surface of the tray there is no necessity to wash or cleanse these components there is no necessity to wash or cleanse these components between uses. A small supply of sheets of flexible material 60 can be carried in a purse or pocket if the person so desires.

Figure 9:
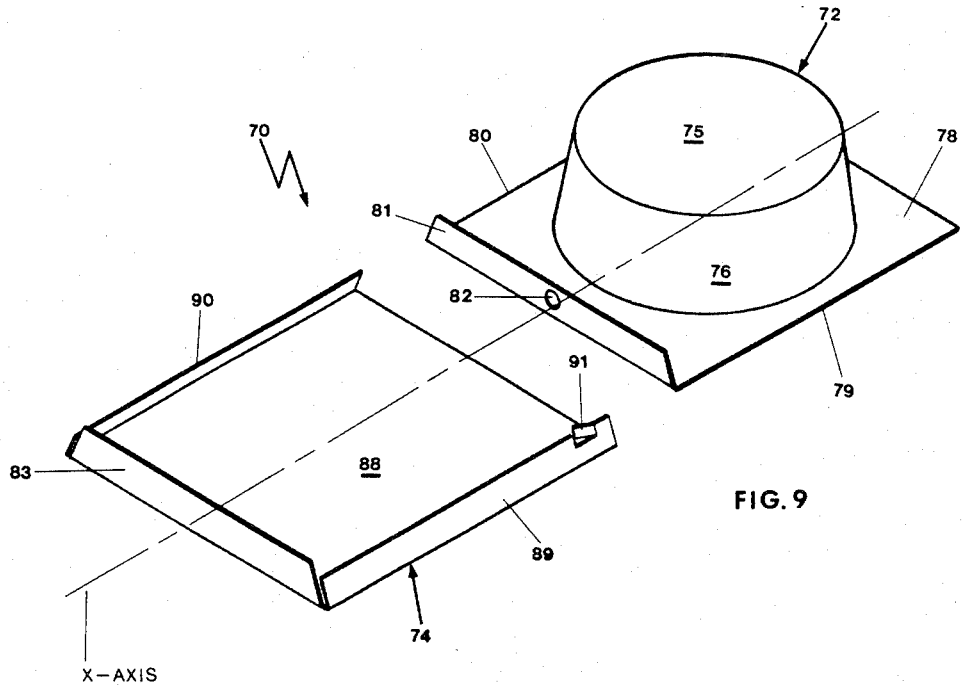
FIG. 9 is an exploded perspective view of a first alternative embodiment of the novel animal droppings pickup device.

A first alternative embodiment of the novel animal droppings pickup device is illustrated in FIG. 9. The device is there designated numeral 70. It has a cover member 72 and a tray 74. Cover member 72 has a top wall 75 and side walls 76. The bottom edge of side walls 76 form an aperture in the bottom of the cover member and a base wall 78 extends laterally therefrom and has side edges 79 and 80. A rear wall 81 extends upwardly from the top surface of base wall 78 and it has an aperture 82 therein through which passes a cord such as illustrated in FIGS. 2 and 3. The tray 74 has a planar base portion 88, and laterally spaced upstanding side walls 89 and 90. A retainer member 91 extends inwardly from side wall 89 to capture rear wall 81 as the cover member 72 is moved to its open position. A rear wall or rim 83 extends upwardly from planar base portion 88. Pickup device 70 functions in the same manner as pickup device 20 and the sequence of stages illustrated in FIGS. 6–8 would be equally applicable.

What is claimed is:

1. A portable device for picking up animal droppings comprising:

a cover member having a top wall, said cover member having a longitudinal axis, side wall means extend downwardly from said top wall with the bottom edge of said side wall means defining an opening;

a tray having a planar base portion, said tray having a longitudinal axis;

said planar base portion having a front edge, a rear edge and lateral side edges, guide means extend upwardly from said planar base portion for guiding said cover member along the longitudinal axis of said tray when said cover member is slid onto said tray, the front edge of said planar base portion is substantially free of any structure that would extend upwardly above the top surface of said planar base portion; and a sheet of flexible material that is first used to cover a pile of animal droppings and which is then automatically wrapped around the animal droppings when said cover member is placed over the sheet of material covering the animal droppings and said cover member is slid onto said tray, said sheet of flexible material being of a predetermined length and this length is greater than the longitudinal dimension of the opening defined by the bottom edge of the side wall means of said cover member.

2. A portable device as recited in claim 1 wherein the planar base portion of said tray is substantially rectangular.

3. A portable device as recited in claim 1 wherein said guide means are positioned along the lateral side edges of said tray for slidingly engaging the lateral side edges of said cover member, these guide means being upstanding side wall members.

4. A portable device as recited in claim 3 wherein at least one of said upstanding side wall members has retaining means for keeping said cover member and tray coupled together.

5. A portable device as recited in claim 3 wherein said upstanding side wall members on said tray slope inwardly at an acute angle.

6. A portable device as recited in claim 1 wherein said tray has an upstanding rear wall.

7. A portable device as recited in claim 1 further comprising a handle attached to the rear end of said cover member for carrying said device around.

8. A portable device as recited in claim 1 wherein the top wall of said cover member is circular in shape and said side wall means forms the vertical section of a cylinder.

9. A portable device for picking up animal droppings comprising:

a cover member having a top wall, said cover member having a longitudinal axis, side wall means extend downwardly from said top wall with the bottom edge of said side wall means defining an opening, the bottom edges of said side wall means having an outwardly extending planar base wall, a rib stiffener member extending laterally along the top surface of the rear of said planar base wall, a handle attached to the rear surface of said rib stiffener member for carrying said device around;

a tray having a planar base portion, said tray having a longitudinal axis;

said planar base portion having a front edge, a rear edge and lateral side edges, the front edge of said planar base portion is substantially free of any structure that would extend upwardly above the top surface of said planar base portion; and longitudinally extending means along the lateral sides of said tray that matingly engages the lateral side edges of said cover member.

10. A method of picking up animal droppings comprising:

(a) placing a sheet of flexible material of a predetermined length over the animal droppings laying on the ground;

(b) taking a portable device for picking up animal droppings having a tray and a cover member, placing the forward end of said tray onto the top surface of said sheet along one of its edges and placing the bottom surface of its cover member down on the sheet of flexible material covering the animal droppings;

(c) sliding the cover member of the portable device onto its tray which causes the forward end of said cover member to push the animal droppings onto said tray and at the same time wrap them within the confines of said sheet of flexible material to form a disposable package.

11. A portable device for picking up animal droppings comprising:

a cover member having a top wall, said cover member having a longitudinal axis, side wall means extend downwardly from said top wall with the bottom edge of said side wall means defining an opening;

a tray having a planar base portion, said tray having a longitudinal axis;

said planar base portion having a front edge, a rear edge and lateral side edges, the front edge of said planar base portion is substantially free of any structure that would extend upwardly above the top surface of said planar base portion;

longitudinally extending means along the lateral sides of said tray that matingly engages the lateral side edges of said cover member; and a sheet of flexible material that is first used to cover a pile of animal droppings and which is then automatically wrapped around the animal droppings when said cover is placed over the sheet of material covering the animal droppings and said cover member is slid onto said tray, said sheet of flexible material being of a predetermined length and this length is greater than the longitudinal dimension of the opening defined by the bottom edge of the side wall means of said cover member.

12. A portable device as recited in claim 11 wherein said longitudinally extending means along the lateral sides of said tray are rib stiffener members having inwardly sloping inner walls that capture the lateral side edges of said cover member.

13. A portable device as recited in claim 1 wherein the bottom edges of the side wall means of said cover member have an outwardly extending planar base wall.

14. A portable device as recited in claim 13 wherein said planar base wall has longitudinally extending alignment guide tracks adjacent its lateral side edges that mate with upwardly protruding retainer members in the top surface of said tray.

15. A portable device as recited in claim 13 further comprising a rib stiffener member extending laterally along the top surface of the rear of said planar base wall.

* * * * *